United States Patent [19]

Onikov et al.

[11] 4,280,537

[45] Jul. 28, 1981

[54] APPARATUS FOR GRIPPING A RUNNING WEFT THREAD ON TRAVELLING-WAVE LOOMS

[76] Inventors: Eduard A. Onikov, ulitsa Panferova, 5 korpus 2, kv. 106; Alexandr L. Galperin, ulitsa Moldogulovoi, 10, korpus 3, kv. 166; Albert S. Serebryannikov, ulitsa Krasikova, 11, kv. 63; Alexandr A. Zabotin, Belyaevo-Bogorodskoe, kvartal 45, korpus 26, kv. 87, all of Moscow; Evgeny D. Loschilin, Domodedovo, Kashirskoe shosse, 36, kv. 87, Moskovskaya oblast, all of U.S.S.R.

[21] Appl. No.: 70,790

[22] Filed: Aug. 29, 1979

[51] Int. Cl.[3] ..... D03D 47/35

[52] U.S. Cl. ..... 139/436; 139/194

[58] Field of Search ..... 139/429, 436, 350, 352, 139/194

[56] References Cited

U.S. PATENT DOCUMENTS

| | | | |
|---|---|---|---|
| 3,237,649 | 3/1966 | Fend | 139/436 |
| 3,989,069 | 11/1976 | Hrdina et al. | 139/436 |
| 4,156,441 | 5/1979 | Peter | 139/452 |

*Primary Examiner*—Henry Jaudon

*Attorney, Agent, or Firm*—Lackenbach, Lilling & Siegel

[57] ABSTRACT

The present invention relates to an apparatus for gripping a weft thread. This apparatus comprises an element for braking a weft thread, representing a tire placed on the periphery of a disk and a gripping block partially embracing the tire, the latter being fabricated from a material with a coefficient of friction against the thread exceeding that of the material of the gripping block.

5 Claims, 4 Drawing Figures

APPARATUS FOR GRIPPING A RUNNING WEFT THREAD ON TRAVELLING-WAVE LOOMS

FIELD OF THE INVENTION

The present invention relates to travelling-wave looms and, more particularly, to an apparatus for gripping a running weft thread used thereon.

BACKGROUND OF THE INVENTION

At present, many firms are trying to develop travelling-wave looms featuring a productivity rate of 5 to 10 times higher than that of the looms now commonly in use.

Adequate designing of individual mechanisms and assemblies of a travelling-wave loom will enable the latter to run at a high speed with minimum time-outs.

One of the principal assemblies in a travelling-wave loom is the mechanism for loading the carriers (shuttles) with a weft thread of a definite length. This mechanism includes, essentially, a weft-winding device, a package-holder and an apparatus for gripping the weft thread. Depending upon the construction of the loom, the loading mechanism may accommodate a number of other mechanisms.

There is known a device for threading carriers with a weft thread for a travelling-wave loom, comprising a rotatably installed weft-winding device, package-holders and a disk with grips (cf. DDR Patent No. 127160), wherein for each weft thread there is provided an individual grip having two gripping lugs, one of which is movable and coupled with the control mechanism thereof. The weft thread occupying the space between the lugs is gripped due to the movable lug being urged against the stationary one.

The disadvantages of these grips include:

(a) structural complexity (an individual grip composed of a number of parts is installed for each thread, and there is provided a provision of systems for controlling these grips);

(b) sluggishness (due to a great number of rotating parts inertial forces appear when the loom is started and stopped);

(c) inconvenience in servicing (the necessity to adjust each grip separately when the loom is refitted in compliance with the operating conditions).

SUMMARY OF THE INVENTION

It is an object of the present invention to provide a structurally simple apparatus for gripping a weft thread.

Another object of the invention is to provide an apparatus which will minimize the sluggishness of the loom in its entirety.

One more object of the invention is to ensure reliability and convenience in operation.

These and other objects of the invention are attained by an apparatus for gripping a running weft thread, comprising a rotatable disk carrying on the periphery an element for braking threads, the elements for braking threads represents a tire arranged on the periphery of the disk and a gripping block partially embracing it, the tire being fabricated from a material with a coefficient of friction against the thread exceeding that of the material of the gripping block.

The gripping block being common to all moving threads simplifies the design and contributes to convenience in servicing. Moreover, due to the employment of a single common block, intricate parts of the gripping element become redundant, whereby the sluggishness of the system as a whole is minimized.

According to the invention, the angle of lap of the gripping block and the tire is adjustable to vary the thread gripping time.

For adjusting the angle of lap, included in the gripping block and mounted on a base are a pair of pulleys and a gripping belt embracing them, the pulleys being installed on the base so that the distance therebetween is variable.

The distance between the pulleys can be changed due to their being disposed in an arcuate slot made in the base. This, in turn, makes it possible to change, if necessary, the duration and point of application of weft thread gripping.

BRIEF DESCRIPTION OF THE DRAWINGS

Given below is a detailed description of the present invention with reference to the accompanying drawings, wherein.

DETAILED DESCRIPTION OF THE INVENTION

Figure 2:
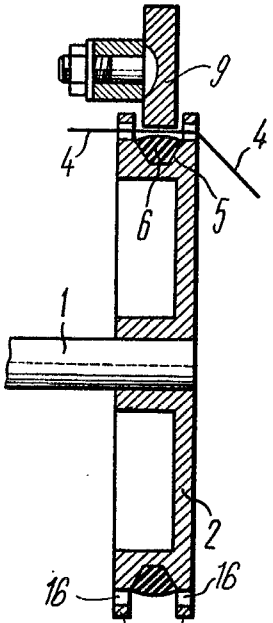
FIG. 2 is a sectional view taken along the line II—II of FIG. 1.
Figure 1:
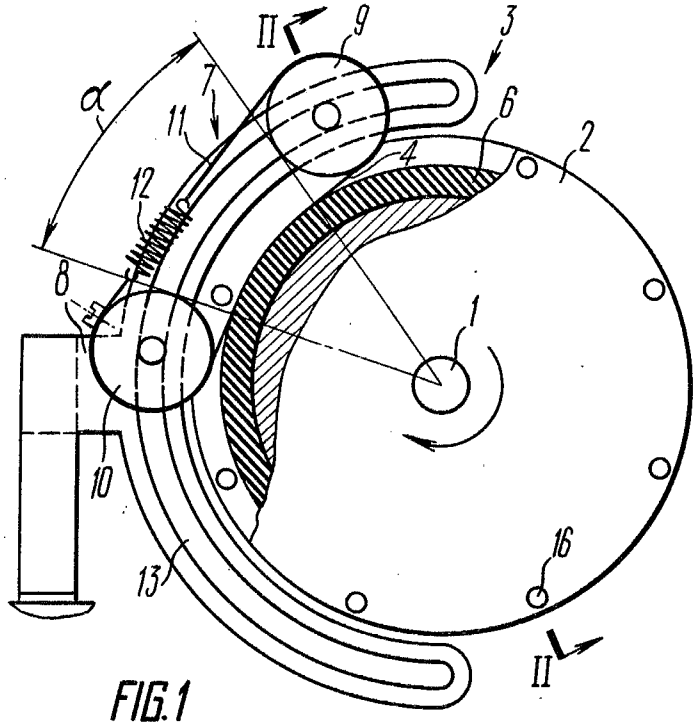
FIG. 1 is a front view of an apparatus for gripping a running thread, made in accordance with the invention.

The proposed apparatus for gripping a running weft thread comprises, on a rotatable shaft 1 (FIG. 1), a disk 2 with an element 3 for braking a weft thread 4 (FIG. 2) arranged on the periphery thereof. The element 3 represents a tire 6 placed in an annular slot 5 and a gripping block 7 partially embracing this tire, the tire 6 being fabricated from a material with a coefficient of friction against the thread exceeding that of the material of the block 7. The angle $\alpha$ of lap of the gripping block 7 and the tire 6 is adjustable, whereby a distance between a pair of pulleys 9 and 10 and hence a duration of the thread gripping may be changed. Included in the gripping block 7 and mounted on a stationary base 8 are a pair of pulleys 9 and 10 and a gripping belt 11 enveloping these pulleys, one end of the belt being secured to the pulley 10 and the other end being connected to the first end through a spring 12.

The pulleys 9 and 10 are mounted on the base 8 so that the distance therebetween can be changed in order to adjust the angle $\alpha$.

The required changes in the distance between the pulleys 9 and 10 are possible due to their being arranged in an arcuate slot 13 made in the base 8.

Figure 3:
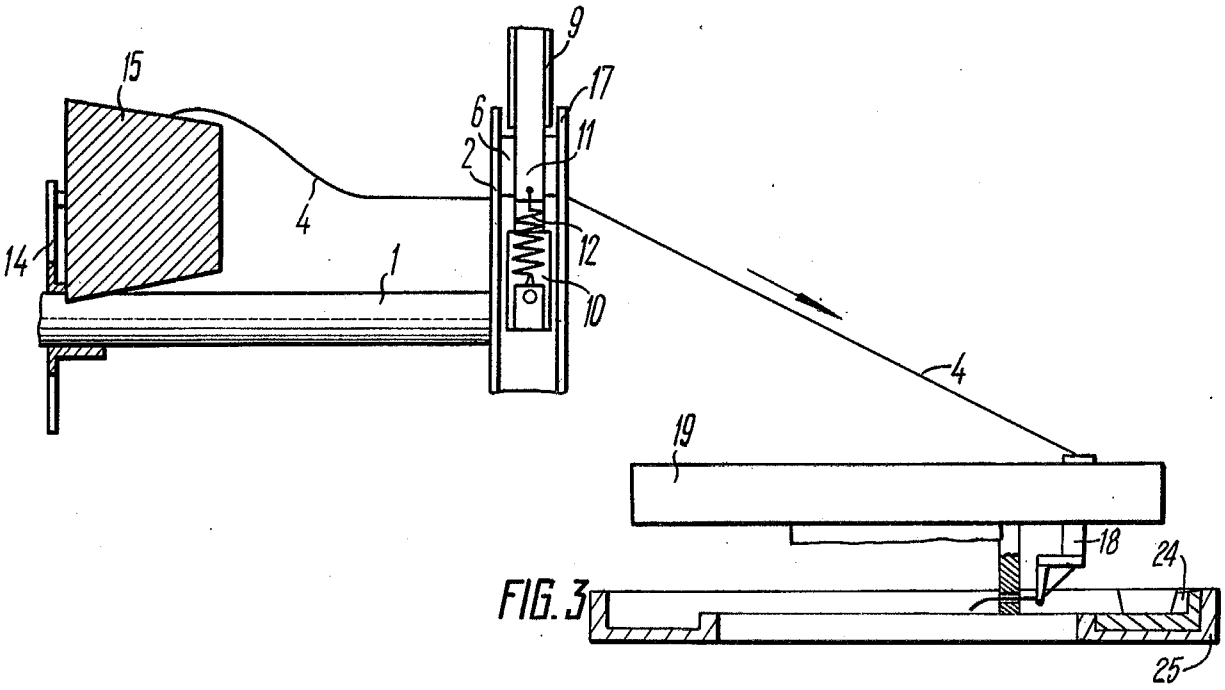
FIG. 3 is a side elevational view, partially in section, of the apparatus shown in FIG. 1.

The shaft 1 also mounts package-holders 14 (FIG. 3) with bobbins 15 for the weft thread 4. For guiding the thread 4, there are provided threadguides 16 installed on ribs 17 of the disk 2.

The thread 4 from the bobbin is placed in the threadguides 14, then in a winding head 18 installed on a rotatable body 19 the speed of rotation of which is equal to that of the disc 2.

Figure 4:
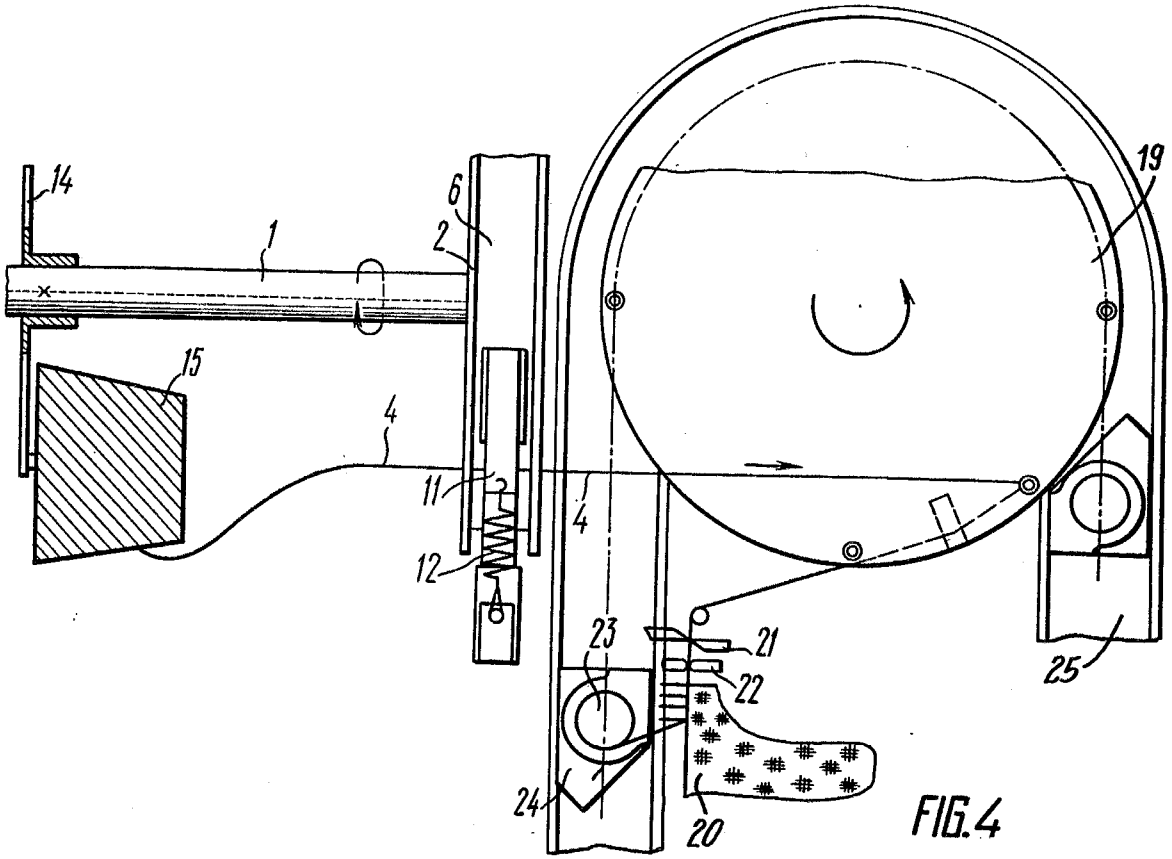
FIG. 4 is another side elevation of the apparatus of FIG. 1.

At the exit side of the apparatus, next to the selvage of a cloth 20 (FIG. 4), there are placed cutters 21 and a grip 22 for the thread being wound onto a spool 23 of a carrier 24 of the weft thread movable in a guide 25.

The apparatus operates as follows.

Placed on the spool 23 of each of the carriers 24 is the weft thread 4 freely unwound from the bobbin 15.

After being threaded, the carriers 24 emerge from under the winding heads 18.

As soon as the weft thread is worked up into the cloth, the cutters 21 sever the thread 4. At the same time, the threadguides 16 place the weft thread between the belt 11 of the gripping block and the tire 6. The force of clamping the weft thread for, while making no obstructions to the movement of the thread along a circumferencal path with the thread guide 16, stops the unwinding of the weft thread from the bobbin 15. When the weft thread 4 is placed between the belt 11 and the tire 6, the path of the thread guides 16 to such extent approximates the path of movement of the winding head. Then, the distance between them starts to increase, and since in this moment the thread 4 cannot unwind from the bobbin 15 as it is clamped between the belt 11 and the tire 6, the severed end of the weft thread is pulled through the winding head 18 in a direction opposite to that during the feed of the weft thread when it is wound onto a spool of the carrier 24 whereby the length of the severed end of the weft thread 4 is caused to diminish. The angle $\alpha$ of gripping of the weft thread 4 can be changed by shifting the pulley 10 relative to the pulley 9 along the arcuate slot 13. The increase of angle $\alpha$ causes an increased duration of clamping of the thread 4, whereby prolonging the period of drawing the weft thread from the winding head 18 in a direction opposite that of the feed of the thread during its winding with the resulted diminishing of the severed end of the thread 4.

The tire is made of a material having a coefficient of friction which is in excess of that between the belt 11 and the thread 4. Therefore, the thread is kept on the surface of the tire 6 rotating therewith and sliding along the surface of the belt 11.

Used as the tire material may be a rubberized cloth with a coefficient of friction against the thread $f>1$, while a polished metal band with a coefficient of friction against the thread $f=0.1-0.2$ may be employed as the gripping block.

What is claimed is:

1. An apparatus for gripping a running weft thread on a travelling-wave loom, comprising; a rotatable disk, a tire arranged on the periphery of said disk; a gripping block partially embracing said tire and forming, together with said tire, an element for braking a weft thread as said weft thread is biased to the gripping block by said rotatable disk, said tire being fabricated from a material with a coefficient of friction against the thread exceeding that of the material of the gripping block; and means for adjusting the angle of lap of the gripping block and tire to enable changing of the thread gripping time.

2. An apparatus as claimed in claim 1, wherein included in the gripping block and mounted on a base are a pair of pulleys and a stationary gripping belt enveloping said pulleys, and the pulleys being installed on the base so that the distance therebetween may be changed to enable adjustment of the angle of lap of the gripping block and said tire.

3. An apparatus as claimed in claim 2, wherein said pair of pulleys is disposed in an arcuate slot made in the base.

4. An apparatus is claimed in claim 1, including thread guides provided on peripheral ribs on said rotatable disk extending radially outwardly from both sides of said tire.

5. An apparatus is claimed in claim 4, wherein said thread guides comprise pairs of oppositely disposed apertures in said peripheral ribs.

* * * * *